US010674789B2

(12) United States Patent
Holt

(10) Patent No.: US 10,674,789 B2
(45) Date of Patent: Jun. 9, 2020

(54) SOLE STRUCTURE FOR AN ARTICLE OF FOOTWEAR WITH SPACED RECESSES

(71) Applicant: NIKE, Inc., Beaverton, OR (US)

(72) Inventor: Scott C. Holt, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 834 days.

(21) Appl. No.: 14/451,468

(22) Filed: Aug. 5, 2014

(65) Prior Publication Data

US 2016/0037860 A1 Feb. 11, 2016

(51) Int. Cl.

| | |
|---|---|
| ***A43B 13/18*** | (2006.01) |
| ***A43B 13/12*** | (2006.01) |
| ***A43B 1/00*** | (2006.01) |

(52) U.S. Cl.

CPC ..... *A43B 13/186* (2013.01); *A43B 1/0009* (2013.01); *A43B 13/125* (2013.01); *A43B 13/187* (2013.01)

(58) Field of Classification Search

CPC ... A43B 1/0009; A43B 13/125; A43B 13/186; A43B 13/187

See application file for complete search history.

(56) References Cited

U.S. PATENT DOCUMENTS 3,087,262 A * 4/1963 Russell ..... A43B 13/181 36/28
4,041,618 A * 8/1977 Famolare, Jr. ..... A43B 13/00 36/25 R
4,133,118 A * 1/1979 Khalsa ..... A43B 7/14 36/29
4,223,456 A * 9/1980 Cohen ..... A43B 13/206 36/29
4,237,627 A 12/1980 Turner
4,547,978 A * 10/1985 Radford ..... A43B 7/081 36/29
5,203,793 A 4/1993 Lyden
5,343,639 A 9/1994 Kilgore et al.
5,353,523 A 10/1994 Kilgore et al.
5,381,607 A 1/1995 Sussmann
6,131,310 A * 10/2000 Fang ..... A43B 13/186 36/28
6,266,896 B1 * 7/2001 Liu ..... A43B 13/14 36/28
7,032,328 B2 4/2006 Wilson et al.
7,118,793 B2 * 10/2006 Wang ..... B29C 44/12 36/44

(Continued)

*Primary Examiner* — Megan E Lynch
(74) *Attorney, Agent, or Firm* — Quinn IP Law

(57) ABSTRACT

A sole structure for an article of footwear includes a midsole having a first side with a first surface and a second side with a second surface. The first side has recesses extending toward the second side without extending to the second surface. A thickness of the midsole between the second side and a deepest extent of each of the recesses may be substantially uniform. Spacing of the recesses may correspond to a foot pressure map. The midsole may be a foam material that has a first density in a first portion along the first surface and a second density less than the first density in a second portion adjacent the first portion. A method of forming the midsole includes providing such recesses in the midsole such as by molding the midsole, and controlling a temperature of mold tools to achieve the first density in the first portion.

19 Claims, 8 Drawing Sheets

(56) References Cited

U.S. PATENT DOCUMENTS 7,276,191 B2 10/2007 Park
7,334,349 B2 2/2008 Sokolowski et al.
7,426,792 B2 9/2008 Swigart et al.
7,475,497 B2 * 1/2009 Hoffer ..... A43B 1/0009 36/28
7,637,033 B2 12/2009 Sokolowski et al.
7,640,679 B2 1/2010 Sokolowski et al.
7,774,954 B2 8/2010 Hoffer et al.
7,941,939 B2 5/2011 Sokolowski et al.
7,997,012 B2 8/2011 Hoffer et al.
8,341,857 B2 1/2013 Dojan et al.
8,468,720 B2 6/2013 Sokolowski et al.
8,479,416 B2 * 7/2013 Auger ..... A43B 7/1445 36/102
8,555,525 B2 * 10/2013 Mahoney ..... A43B 7/144 36/25 R
2002/0152640 A1 * 10/2002 Wu ..... A43B 13/14 36/87
2003/0150134 A1 8/2003 Hardt
2006/0123662 A1 * 6/2006 Kang ..... A43B 5/00 36/25 R
2006/0156579 A1 * 7/2006 Hoffer ..... A43B 1/0009 36/28
2009/0183387 A1 7/2009 Ellis
2010/0050471 A1 * 3/2010 Kim ..... A43B 7/081 36/29
2011/0232135 A1 * 9/2011 Dean ..... A43B 13/04 36/25 R
2011/0272085 A1 11/2011 Hoffer et al.
2012/0084998 A1 4/2012 Biesse
2012/0151793 A1 * 6/2012 Lin ..... A43B 7/148 36/28
2012/0174439 A1 * 7/2012 O'Connor ..... A43B 3/108 36/91
2012/0180336 A1 * 7/2012 Sullivan ..... A43B 7/144 36/31
2013/0125416 A1 5/2013 Hoffer et al.
2013/0180023 A1 7/2013 Gross et al.
2013/0276333 A1 * 10/2013 Wawrousek ..... A43B 1/0009 36/102
2013/0303041 A1 * 11/2013 Kim ..... A43B 1/0009 442/1
2014/0182170 A1 * 7/2014 Wawrousek ..... A43B 7/14 36/103
2014/0196308 A1 * 7/2014 Baratta ..... A43B 13/184 36/29
2014/0259801 A1 * 9/2014 Grondin ..... A43B 13/187 36/30 R
2015/0128452 A1 * 5/2015 Hull ..... A43B 13/14 36/103
2015/0223563 A1 * 8/2015 Liebeno ..... A43B 13/16 36/31
2016/0262490 A1 9/2016 Yu et al.

* cited by examiner

SOLE STRUCTURE FOR AN ARTICLE OF FOOTWEAR WITH SPACED RECESSES

TECHNICAL FIELD

The present teachings generally include a sole structure and an article of footwear having the sole structure.

BACKGROUND

Footwear typically includes a sole configured to be located under a wearer's foot to space the foot away from the ground or floor surface. Sole structure can be designed to provide a desired level of cushioning. Athletic footwear in particular sometimes utilizes polyurethane foam or other resilient materials in the sole structure to provide cushioning. It is also beneficial for the sole structure for an article of athletic footwear to have a ground contact surface that provides sufficient traction and durability for an athletic endeavor.

SUMMARY

A sole structure for an article of footwear includes a midsole that has a first side with a first surface and an opposite second side with a second surface. The first side has a plurality of recesses extending toward the second side without extending to the second surface. The recesses are configured so that a thickness of the midsole between the second side and a deepest extent of each of the recesses is substantially uniform. By including recesses in the midsole, a higher density material can be used without increasing the overall weight of the midsole. A higher density foam may achieve greater resiliency and avoid compression set in comparison to a lower density foam. Compression set is the permanent loss of resiliency of a foam midsole after extensive use.

The midsole may be a foam material that has a first density in a first portion along the first surface, and a second density less than the first density in a second portion adjacent the first portion. By increasing the density of only the first portion, resiliency goals may be achieved with minimal overall weight. With such a construction, if the midsole with the recesses has a first weight, a volume of the foam material having the second density and equivalent to a volume of the midsole without any recesses will have a second weight at least as great as the first weight. In other words, volume is reduced due to the recesses, and since greater density foam is used strategically only in the first portion, resiliency is optimized without weight increase.

In one embodiment, the recesses are spaced from one another in correspondence with pressure zones of a predetermined foot pressure map. For example, with such a configuration, a first set of recesses in a relatively high pressure region of the foot pressure map are further from one another than a second set of recesses in a relatively low pressure region of the foot pressure map. Additionally, at least some of the recesses in the relatively low pressure region have a larger effective diameter than at least some of the recesses in the relatively high pressure region.

A method of forming a midsole for an article of footwear includes providing a plurality of recesses in the midsole that extend from a first side of the midsole toward a second side of the midsole opposite from the first side. The recesses are configured to extend from the first side only partway toward an outer surface at the second side so that a thickness of the midsole between the second side and a deepest extent of each of the recesses is substantially uniform. Providing the plurality of recesses may include spacing the recesses in correspondence with a predetermined foot pressure map so that the recesses are spaced further from one another in a relatively high pressure zone than in a relatively low pressure zone. The midsole may be a foam material, with the recesses provided by molding the midsole. The method may include controlling a temperature of mold tools used to mold the midsole such that a foam material contacting the mold tools forms an outer skin having a density greater than a density of the foam material not in contact with the mold tools.

The above features and advantages and other features and advantages of the present teachings are readily apparent from the following detailed description of the best modes for carrying out the present teachings when taken in connection with the accompanying drawings.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., as used descriptively for the figures, do not represent limitations on the scope of the claims.

DETAILED DESCRIPTION

Figure 1:
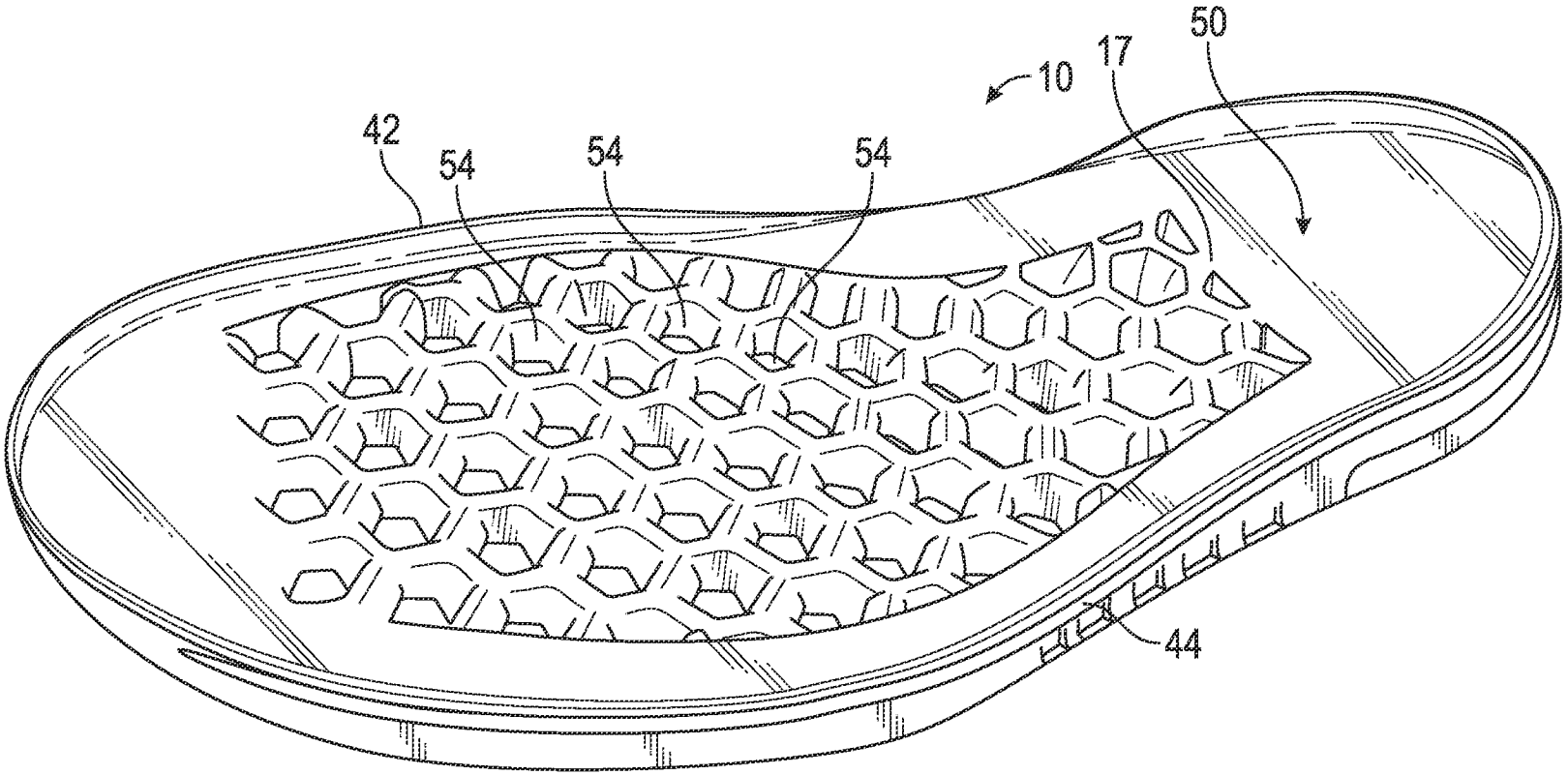
FIG. 1 is a schematic illustration in perspective view of a midsole for an article of footwear.
Figure 2:
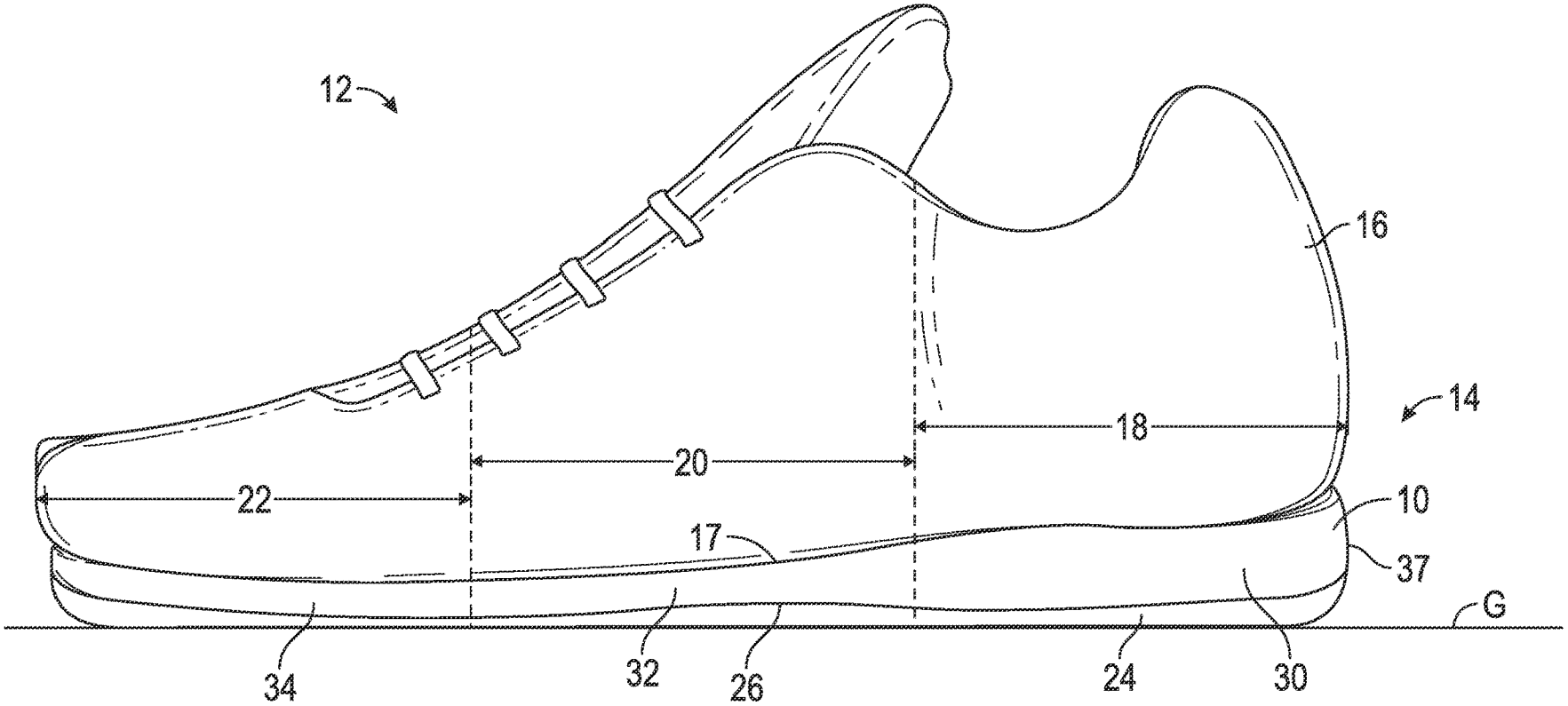
FIG. 2 is a schematic illustration in side view of an article of footwear with a sole structure having the midsole of FIG. 1.

Referring to the drawings, wherein like reference numbers refer to like components throughout the several views, FIG. 1 shows a midsole 10 of an article of footwear 12 of FIG. 2. The article of footwear 12 includes a sole structure 14. The article of footwear 12 may include a footwear upper 16 attached to a first side 17 of the sole structure 14 that faces the upper 16. The article of footwear 12 is dimensioned according to a specific size chart for a human foot. As shown, the article of footwear 12 is an athletic shoe. In other embodiments, the article of footwear 12 could be a dress shoe, a work shoe, a sandal, a slipper, a boot, or any other category of footwear. The article of footwear 12 has a heel region 18, a midfoot region 20, and a forefoot region 22. The heel region 18 generally includes portions of the article of footwear 12 corresponding with rear portions of a human foot of the size of the article of footwear 12, including the calcaneus bone. The midfoot region 20 generally includes portions of the article of footwear 12 corresponding with an arch area of the human foot of the size of the article of footwear 12. The forefoot region 22 generally includes portions of the article of footwear 12 corresponding with the toes and the joints connecting the metatarsals with the phalanges of the human foot of the size of article of footwear 12.

The sole structure 14 may also be referred to as a sole assembly, as it may include multiple components. For example, the sole structure 14 may include the midsole 10, which can be a resilient sole component attached to and positioned under the footwear upper 16 when the sole structure 14 is resting on a level plane of the ground G. The midsole 10 may be a material that combines a desired level of resiliency and support, such as a polyurethane or an ethylene vinyl acetate (EVA) foam. For example, a desired level of resiliency, as measured by energy return, may be 55 percent. A desired level of compression set for the midsole 10 may be less than 20 percent under a standardized compression set test.

An outsole 24 or multiple outsole elements can be secured to a second side 26 of the midsole 10 that faces away from the upper 16. The outsole 24 can be a material configured to increase traction with the ground G, such as a rubber material. Alternatively, the midsole 10 can be a unitary sole component configured to serve the functions of both cushioning and fraction, without a separate outsole.

Figure 3:
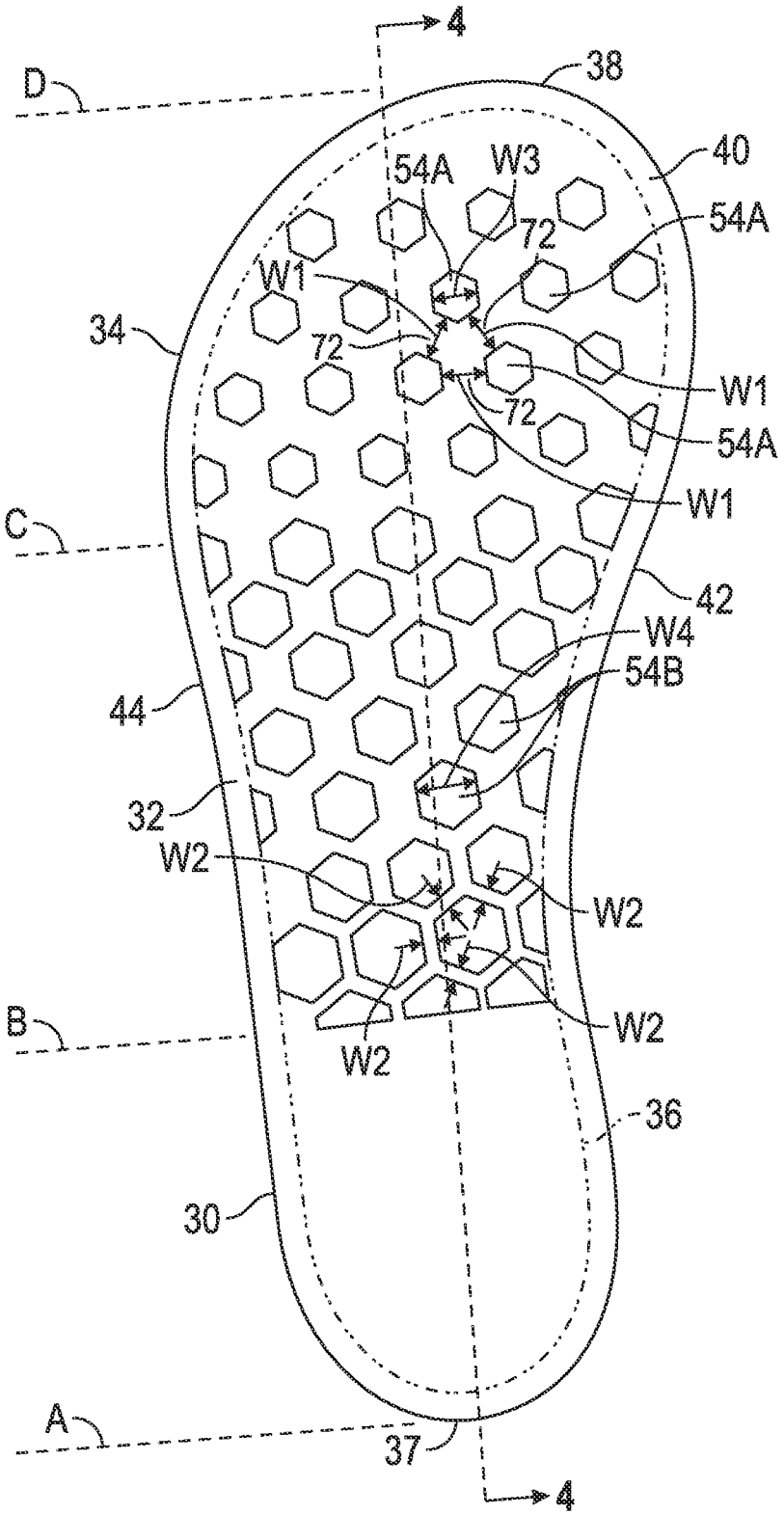
FIG. 3 is a schematic illustration in top view of the midsole of FIG. 1.

The midsole 10 has a heel portion 30, a midfoot portion 32, and a forefoot portion 34. The heel portion 30, the midfoot portion 32, and the forefoot portion 34 correspond with the heel region 18, the midfoot region 20, and the forefoot region 22, respectively, of the article of footwear 12. The heel portion 30 of the midsole is defined as approximately the rear third of the midsole 10, and is shown in FIG. 3 as extending from a rear distal end 37 of the midsole 10 at line A to the line B. The midfoot portion 32 of the midsole 10 is defined as the middle third of midsole 10, and is shown in FIG. 3 as extending from line B to line C. The forefoot portion 34 of the midsole 10 is defined as the front third of the midsole 10, and is shown in FIG. 3 as extending from line C to line D, which corresponds to a foremost extent 38 of the midsole 10. A perimeter portion 40 of the midsole 10 surrounds an outer extent of the heel portion 30, the midfoot portion 32 and the forefoot portion 34, and extends inward to a boundary 36 indicated in phantom. The position of the boundary 36 can be determined based on desired cushioning effects. The perimeter portion 40 extends from the foremost extent 38 to the rear distal end 37 along both a medial side 42 and a lateral side 44. As used herein, a lateral side 44 of the midsole 10 is a side that corresponds with the side of the foot of the wearer of the article of footwear 12 that is closer to the fifth toe of the wearer. The fifth toe is commonly referred to as the little toe. A medial side 42 of the midsole 10 is the side that corresponds with an inside area of the foot of the wearer and is generally closer to the hallux of the foot of the wearer. The hallux is commonly referred to as the big toe.

Figure 4:
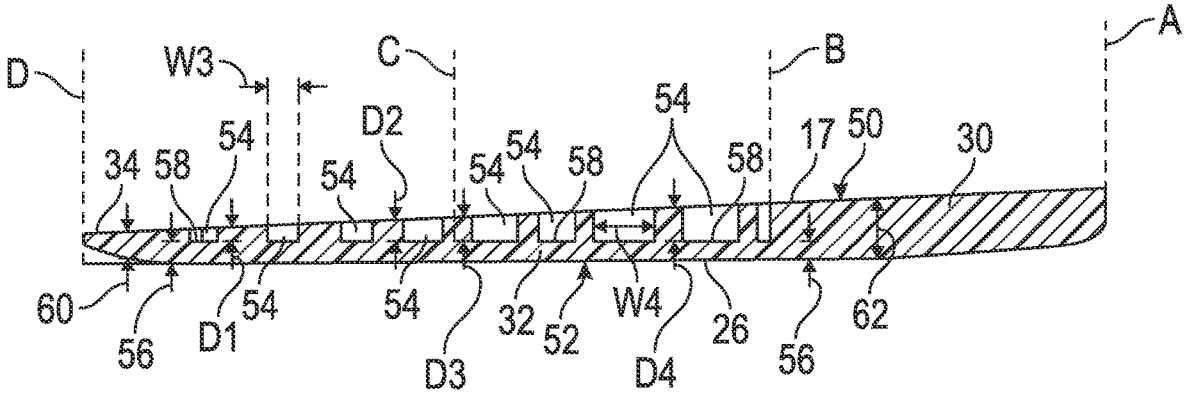
FIG. 4 is a schematic illustration in cross-sectional view of the midsole taken at lines 4-4 in FIG. 3.
Figure 5:
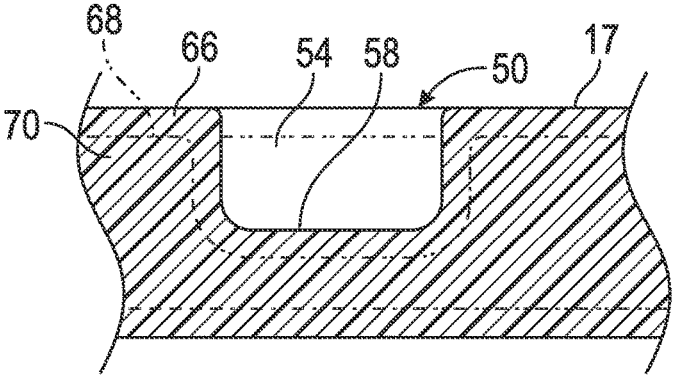
FIG. 5 is a schematic illustration in close-up cross-sectional view of a portion of the midsole of FIG. 4 indicating a denser skin portion bounded by phantom lines.

Referring to FIG. 4, the first side 17 of the midsole 10 has a first surface 50, and the second side 26 has a second surface 52. The second side 26 and the second surface 52 are opposite from the first side 17 and the first surface 50. The upper 16 may be secured to the first surface 50, and the outsole 24 may be secured to the second surface 52. The first side 17 has a plurality of recesses 54 extending toward the second side 26 without extending to the second surface 52. As best shown in FIG. 4, the recesses 54 are configured so that a thickness 56 of portions of the midsole 10 between the second side 26 and a deepest extent 58 of each of the recesses 54 is substantially uniform. However, the overall thickness of the midsole 10 varies between the first surface 50 and the second surface 52. For example, the midsole 10 has a thickness 60 in an area of the forefoot region 34 that is significantly less than a thickness 62 in an area of the heel region 30. As used herein, "a deepest extent" of a recess is that part of the recess closest to the second surface 52 where the bottom surface of each recess is relatively flat, as shown in FIG. 5.

Figure 6:
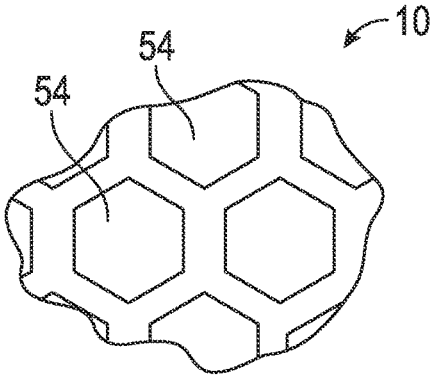
FIG. 6 is a schematic illustration in fragmentary top view of the midsole of FIG. 1.
Figure 7:
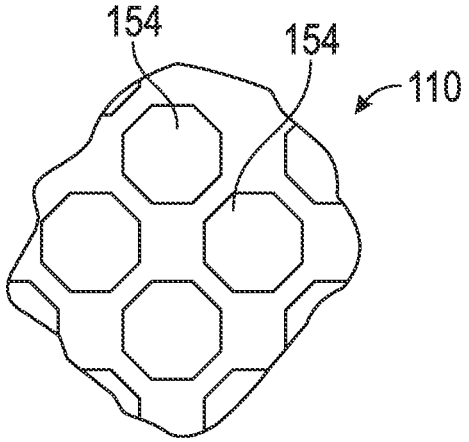
FIG. 7 is a schematic illustration in fragmentary top view of an alternative midsole with recesses having a different shape.
Figure 8:
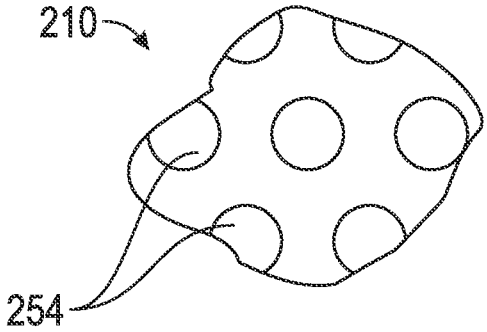
FIG. 8 is a schematic illustration in fragmentary top view of an alternative midsole with recesses having another different shape.

As best shown in FIGS. 3 and 6, the recesses 54 are distributed in the forefoot portion 34 and the midfoot portion 32, while the heel portion 30 is free from recesses. In other embodiments, recesses may be located in the heel portion 30 as well. The recesses 54 of the midsole 10 shown in FIG. 3 have a hexagonal shape and are open at the surface 50. In other embodiments, the recesses 54 can have different shapes. For example, FIG. 7 shows a portion of a midsole 110 having recesses 154 with a generally octagonal shape. The arrangement of the recesses 54, 154, 554 of midsoles 10, 110, 510, respectively, can be referred to as a honeycomb pattern. FIG. 8 shows a portion of a midsole 210 having recesses 254 with a generally circular shape.

The recesses 54 decrease the overall volume of the midsole 10 in comparison to a midsole having the same dimensions as midsole 10 but with foam in place of the recesses. With the reduced overall volume of the midsole 10, a more dense foam can be used without an increase in overall weight. A foam with greater density may better meet desired resiliency and compression set parameters. In the embodiment of FIG. 1, placing the recesses 54 in the forefoot portion 34 and in the midfoot portion 32 provide flexibility in these areas. The heel region 30 and the forwardmost extent of the forefoot region 34, in the area likely to be underneath a wearer's toes, is free from recesses. The greater thickness of the midsole in the Z direction (i.e., along an axis perpendicular to the ground plane G), provides greater cushioning and resiliency in these areas.

Figure 9:
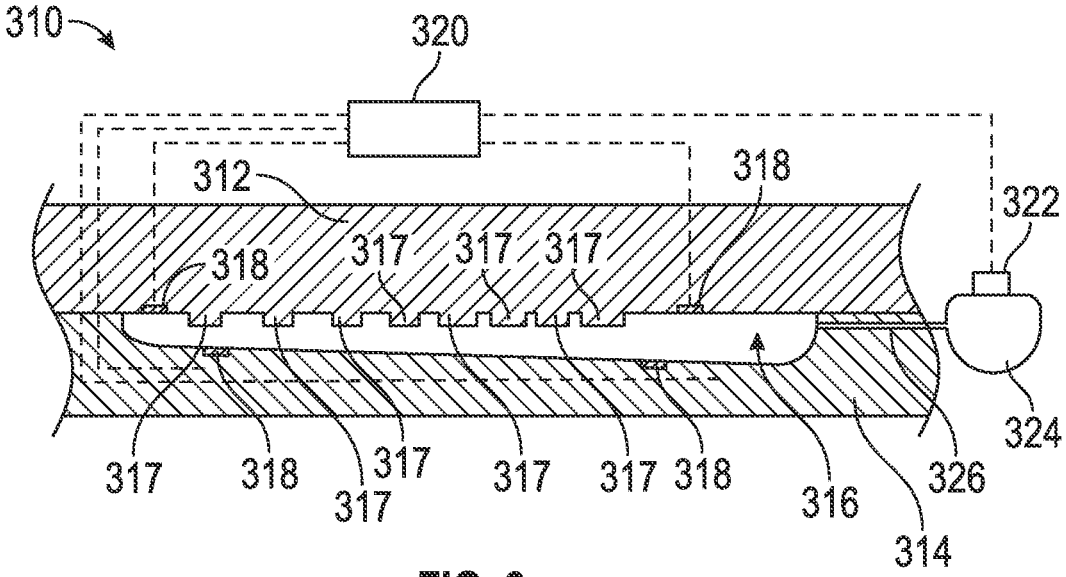
FIG. 9 is a schematic illustration in fragmentary cross-sectional view of a mold assembly for the midsole of FIG. 1, with a control system for controlling the temperature of the mold tools.
Figure 10:
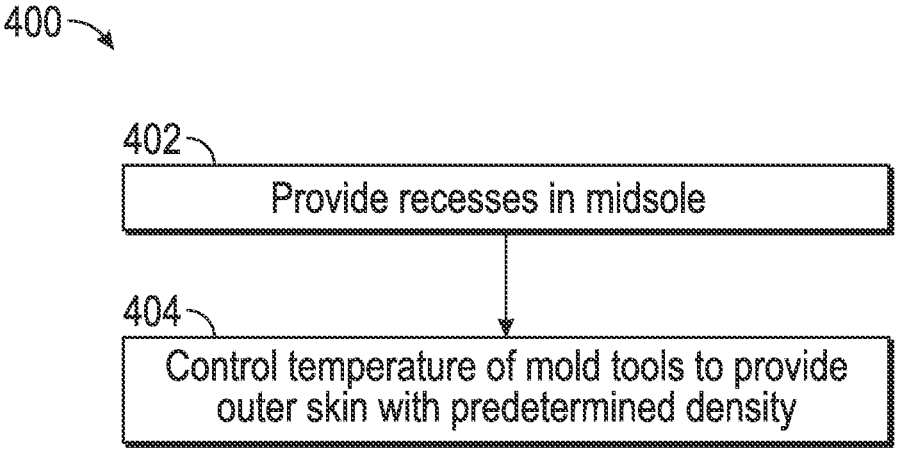
FIG. 10 is a flow diagram of a method of molding the midsole of FIG. 1.

As discussed further herein with respect to FIGS. 9 and 10, the midsole 10 is manufactured so that a higher density first portion 66 is provided at the outer surface of the midsole 10. In other words, the first portion 66 includes the entire outer surface of the midsole 10, and extends inward to a boundary 68 at which the foam transitions to an adjacent second portion 70 of a lower density than the first portion 66. The first portion 66 can also be referred to herein as a skin 66. Additionally, the greater density of the first portion 66 bounds each of the recesses 54, as indicated in FIG. 5. Even though the first portion 66, including the surfaces 50, 52, is of a greater density than the second portion 70, because the recesses 54 decrease the overall volume of foam included in the midsole 10 in comparison to a midsole of the same dimensions but without the recesses 54, the overall weight of the midsole 10 is not more than that of the midsole having the same dimensions as midsole 10 but with foam in place of the recesses. In fact, the reduction in weight afforded by the recesses may allow the density of the second portion 70 to be 30 to 40 percent greater than the density of a midsole of the same dimensions but without the recesses 54. The first portion 66 would be of even greater density with respect to the midsole of the same dimensions but without the recesses 54. Although described with respect to midsole 10, any of the other midsoles 110, 210, 510 can also be manufactured with such portions 66, 70.

Referring again to FIG. 3, the recesses 54 can be generally discussed as a first set of recesses 54A in the forefoot portion 34, and a second set of recesses 54B in the midfoot portion 32. Only some of the recesses 54A, 54B are labeled with reference numbers in FIG. 3. As is apparent in FIG. 3, the recesses 54B are closest to one another nearest to the heel portion 30, and spaced further from one another gradually in a direction toward the forefoot portion 34. Similarly, the recesses 54A are closest to one another nearest the midfoot portion 32, and spaced further from one another gradually in a direction toward the foremost extent 38. The recesses 54A are spaced from one another so that the foam of the midsole 10 has a first minimum wall thickness W1 between adjacent ones of the recesses 54A. In other words, the midsole 10 between the recesses 54A can be referred to as wall portions 72. The thinnest area of the wall portions 72, or the minimum wall thickness W1, is between adjacent ones of the first set of recesses 54A nearest the midfoot portion 32.

The recesses 54B are spaced from one another so that the foam of the midsole 10 has a second minimum wall thickness W2 between adjacent ones of the recesses 54B. In other words, the thinnest area of each of the wall portions 72 between the recesses 54B has a second minimum wall thickness W2. The second minimum wall thickness W2 is less than the first minimum wall thickness W1. During typical usage of the article of footwear 12, more of the wearer's weight is borne by the forefoot portion 34 than by the midfoot portion 32, both statically and dynamically. Because the first minimum wall thickness W1 is greater than the second minimum wall thickness W2, the forefoot portion 34 will provide greater cushioning than the midfoot portion 32, and sufficient resiliency for the greater loads in the forefoot portion 34. The recesses 54A are smaller in cross-sectional width W3 than the cross-sectional width W4 of the recesses 54B, as is evident in FIGS. 3 and 4. In other embodiments, however, the recesses 54A and 54B can be of the same cross-sectional width, but with the wider minimum wall thickness W1 still separating the recesses 54A.

Figure 11:
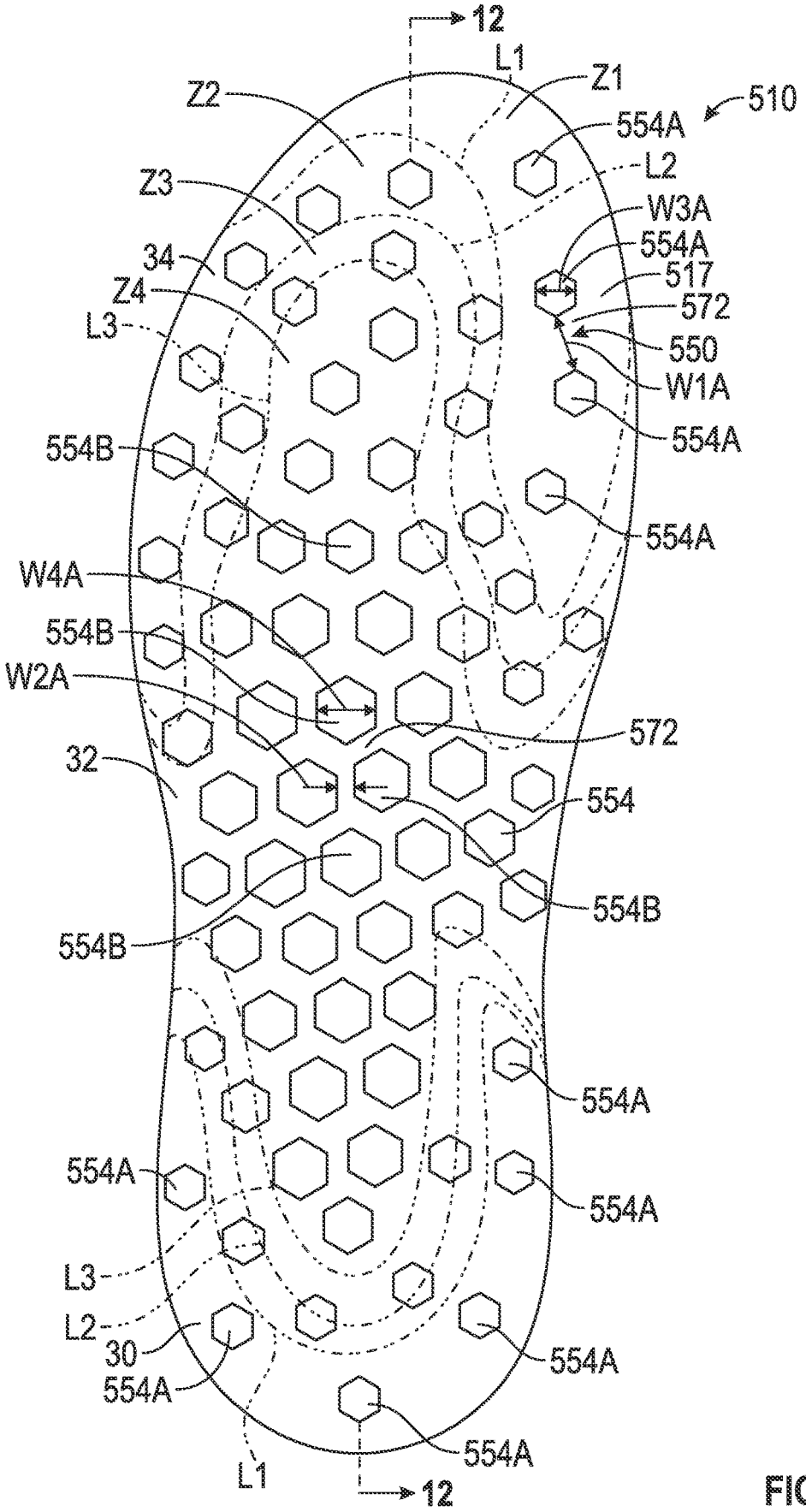
FIG. 11 is a schematic illustration in top view of an alternative midsole.
Figure 12:
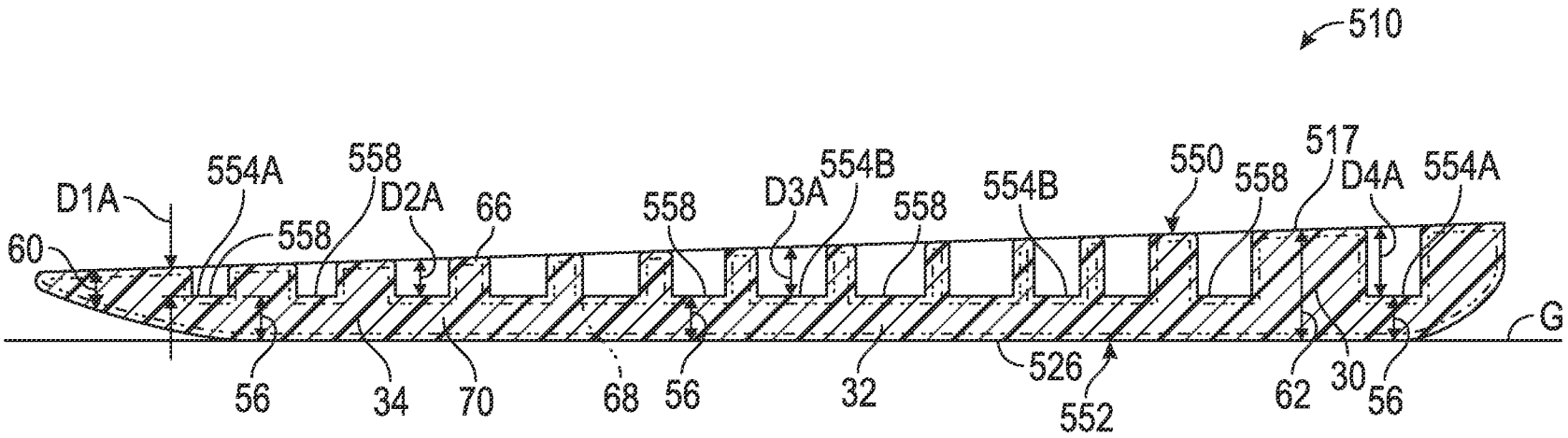
FIG. 12 is a schematic illustration in cross-sectional view of the alternative midsole taken at arrows 12-12 in FIG. 11.

FIG. 11 shows another embodiment of a midsole 510 having a heel portion 30, a midfoot portion 32, and a forefoot portion 34 as described with respect to the midsole 10. A first side 517 and first surface 550 of the midsole 510 are shown in FIG. 11. An opposite second side 526 with a second surface 552 is indicated in FIG. 12.

Figure 13:
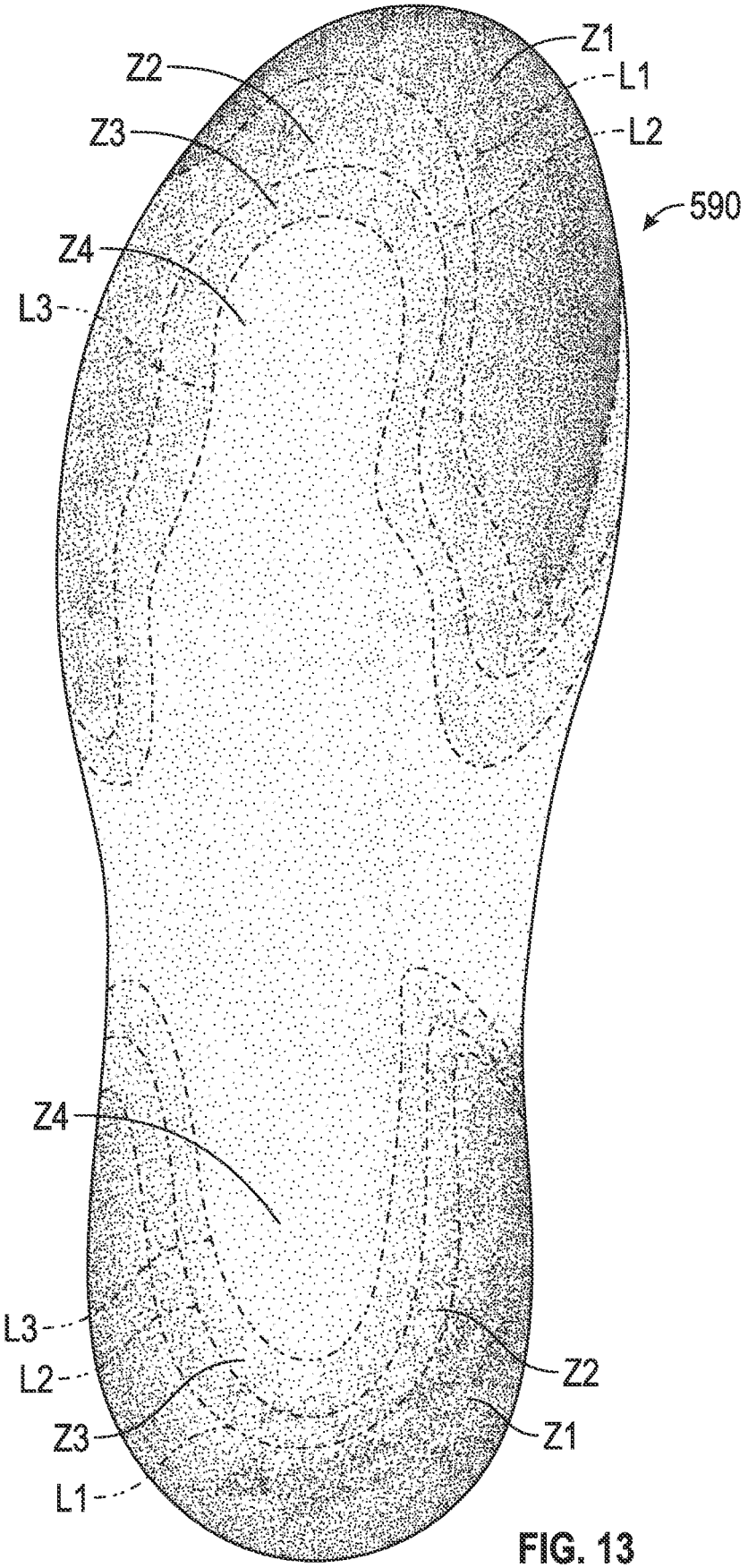
FIG. 13 is a schematic illustration of a pressure map of a foot indicating regions of different pressure zones separated by phantom boundaries.

The midsole 510 has recesses 554 spaced in correspondence with pressure regions Z1, Z2, Z3, Z4 of a predetermined foot pressure map 590 shown in FIG. 13. The pressure regions Z1, Z2, Z3, Z4 are also referred to as pressure zones. The foot pressure map 590 indicates the shape and location of numerous pressure zones Z1, Z2, Z3, and Z4. Each pressure zone Z1, Z2, Z3, Z4 represents a different range of pressures on a midsole, and corresponding pressures on the test wearer's foot, during a wear test of a midsole. The pressure zones may be averages of data taken from many wear tests to thereby represent an average wearer's foot. Phantom lines L1, L2, and L3 generally represent the boundary or transition between adjacent pressure zones. L1 is the boundary between pressure zone Z1 and pressure zone Z2. L2 is the boundary between pressure zone Z2 and pressure zone Z3. L3 is the boundary between pressure zone Z3 and pressure zone Z4.

The magnitude of pressures in each pressure zone Z1, Z2, Z3, Z4 is indicated by the density of shading. Pressure zone Z1 covers the areas of the test midsole that experienced the highest range of pressures. Pressure zone Z2 covers an area of the test midsole that experienced a lower range of pressures than in pressure zone Z1. Pressure zone Z3 covers an area of the test midsole that experienced a lower range of pressures than either of zones Z1 and Z2. Pressure zone Z4 covers an area of the test midsole that experienced a lower range of pressures than any of zones Z1, Z2 and Z3. The various pressure zones Z1, Z2, Z3, and Z4 and boundaries L1, L2, and L3 are reproduced on the midsole 510 in FIG. 11. FIG. 11 indicates that the spacing of the recesses 554 from one another is configured to correspond with the pressure map 590 of FIG. 12. For example, a first set of recesses 554A in the highest pressure zone Z1 are spaced further from one another than a second set of recesses 554B in the lowest pressure zone Z4 of the foot pressure map 590. Only some of the recesses 554B in pressure zone Z4 are labeled in FIG. 11 for clarity in the drawing. The recesses 554 have a generally hexagonal shape, but may have other shapes. As is apparent in FIG. 11, the recesses 54B are closest to one another in the lowest pressure zone Z4, and spaced further from one another gradually in a direction toward the highest pressure zone Z1. The highest pressure zone Z1 is found generally at the medial side of the forefoot portion 34 and at the heel portion 30, in a generally U-shape.

The recesses 554A are spaced from one another so that the foam of the midsole 510 has a first minimum wall thickness W1A between adjacent ones of the recesses 554A. In other words, the midsole 510 between the recesses 554A can be referred to as wall portions 572. The thinnest area of the wall portions 572 is the minimum wall thickness W1A in the pressure zone Z1. The recesses 554B in the pressure zone Z4 are spaced from one another so that the foam of the midsole 510 has a second minimum wall thickness W2A between adjacent ones of the recesses 554B. In other words, the thinnest area of each of the wall portions 572 between the recesses 554B has a second minimum wall thickness W2A. The second minimum wall thickness W2A is less than the first minimum wall thickness W1A.

The spacing of the recesses 554 in pressure zones Z2 and Z3 transition between the spacing in zone Z1 and Z2, with the recesses in pressure zone Z2 closer than those in zone Z3, but further than those in zone Z1, and the recesses in pressure zone Z3 closer than those in zone Z4. The recesses in the relatively low pressure zone Z4 have a larger effective diameter or cross-sectional width W4A than at least some of the recesses in the relatively high pressure region Z1, which have an effective diameter or cross-sectional width W3A.

The midsole 510 is manufactured so that a higher density first portion 66 is provided at the outer surface of the midsole 510. In other words, the first portion 66 includes the entire outer surface of the midsole 510, and extends inward to a boundary 68 at which the foam transitions to an adjacent second portion 70 of a lower density than the first portion 66. Additionally, the greater density of the first portion 66 bounds each of the recesses 554. Even though the first portion 66, including the surfaces 550, 552, is of a greater density than the second portion 70, because the recesses 554 decrease the overall volume of foam included in the midsole 510 in comparison to a midsole of the same dimensions but without the recesses 554, the overall weight of the midsole 510 is not more than that of the midsole having the same dimensions as midsole 510 but with foam in place of the recesses. In fact, the reduction in weight afforded by the recesses 554 may allow the density of the second portion 70 to be 30 to 40 percent greater than the density of a midsole of the same dimensions but without the recesses 554. The first portion 66 would be of even greater density with respect to the midsole of the same dimensions but without the recesses 554.

Referring to FIG. 4, because the midsole 10 has a thickness 60 in an area of the forefoot portion 34 that is significantly less than a thickness 62 in an area of the heel portion 30, at least some of the recesses 54A have different depths than one another as indicated by depths D1 and D2 in FIG. 4. Similarly, at least some of the recesses 54B have different depths than one another as indicated by depths D3 and D4. Despite the different depth D1, D2, D3, D4, the thickness 56 remains substantially uniform throughout the midsole 10. As used herein, substantially uniform means that the variation in the thickness 56 is not more than the dimensional tolerance that would be permitted in a production midsole 10.

Like midsole 10, the recesses 554 are configured so that a thickness 56 of portions of the midsole 510 between the second side 526 and a deepest extent 558 of each of the recesses 554 is substantially uniform, as shown with respect to midsole 10 in FIG. 4. The overall thickness of the midsole 510 varies between the first surface 550 and the second surface 552. For example, the midsole 510 has the same thicknesses as midsole 10 shown in FIG. 4, with a thickness 60 in an area of the forefoot region 34 that is significantly less than a thickness 62 in an area of the heel region 30. At least some of the recesses 554 have different depths, as indicated by depths D1A, D2A, D3A, and D4A in FIG. 12. In fact, recesses 554 with depths D1A and D4A are both in pressure zone Z1, while recesses 554 with depths D2A, D3A are both in pressure zone Z4. The recesses 154, 254 of midsoles 110, 210 are similarly configured.

FIG. 9 shows a mold assembly 310 that can be used to mold any of the midsoles 10, 110, 210, 510, and is described with respect to midsole 10 of FIG. 1. The mold assembly 310 includes a first mold tool 312 and a second mold tool 314 that are configured to define a mold cavity 316 when closed together as shown in FIG. 9. The mold tools 312, 314 are openable, such as at a hinge or otherwise to allow the midsole 310 to be removed from the mold assembly 10 after forming, as is understood by those skilled in the art. The mold tool 312 is shown with protrusions 317 that result in the recesses 54. In other embodiments the recesses 54 can be cored in the midsole after molding of the midsole. In such an embodiment, the mold tool 312 would not have the protrusions that form the recesses 54. Additionally, in such an embodiment, the first portion 66 providing the denser skin would not cover all sides of the recess 54 or the lowest extent of the recess 54, as these surfaces would be provided after molding.

A plurality of temperature sensors 318 are positioned on the mold tools 312, 314 to determine an operating temperature of the respective mold tool 312, 314 and/or of the foam material injected into the mold cavity 316 during formation of the midsole 10. The temperature sensors 318 are operatively connected to a controller 320 and are configured to transfer sensor signals to the controller 320, either by wiring, wirelessly, or otherwise. The controller 320, in turn, provides a control signal to a heater 322. The heater 322 heats foam material at a supply chamber 324 from which the foam material is provided via one or more conduits 326 to the cavity 316. The controller 320 is thus operable to control the temperature at the outer surface of the midsole 10 during formation. The temperature of formation affects the density of the midsole 10. By controlling the temperature of the outer surface of the midsole 10, the skin 66 is formed.

FIG. 10 is a flow diagram of a method 400 of forming the midsole 10 for the article of footwear 12. Although described with respect to the midsole 10, the method 400 can be used to form the midsoles 110, 210, 510 as well. The method 400 includes step 402, providing a plurality of recesses in the midsole 10 that extend from a first side 17 of the midsole 10 toward a second side 26 of the midsole 10 opposite from the first side 17. The recesses 54 are configured to extend from the first side 17 only partway toward an outer surface 52 at the second side 26 so that a thickness 56 of the midsole 10 between the second side 26 and a deepest extent 58 of each of the recesses 54 is substantially uniform. For example, the midsole 10 can be a foam material, and the plurality of recesses 54 can be provided by molding the midsole 10 in the mold assembly 310 as described with respect to FIG. 9. In another embodiment of the midsole 10, the recesses 54 can be provided in step 402 by coring after molding of a midsole without recesses. In the embodiment of FIG. 11, the recesses 554 are produced by configuring the mold tool 312 so that the spacing of the protrusions 317 correspond to the pressure map 590.

The recesses 54 can be provided in step 402 while controlling a temperature of mold tools 312, 314 used to mold the midsole 10 in step 404 such that the foam material contacting the mold tools 312, 314 forms an outer skin, also referred to as the first portion 66, that has a first density greater than a second density of the foam material not in contact with the mold tools. That is, the density of the first portion 66 of FIG. 5 is greater than the density of the foam material of the second portion 70. For example, the mold tools can be controlled in step 404 to a sufficiently low temperature so that the molded foam cools at the surface in contact with the mold tools 312, 314 to achieve a greater density in the first portion 66. Additionally, the volume of blowing agents may be increased in comparison to use when molding a midsole without the skin and of a uniform second density.

While the best modes for carrying out the many aspects of the present teachings have been described in detail, those familiar with the art to which these teachings relate will recognize various alternative aspects for practicing the present teachings that are within the scope of the appended claims.

What is claimed is:

1. A sole structure for an article of footwear comprising:

a midsole that has a first side with a first surface and a second side with a second surface; wherein:

the second side is opposite from the first side; wherein the midsole has a heel portion, a midfoot portion, and a forefoot portion, the forefoot portion extending from a foremost extent of the midsole to the midfoot portion;

the first side has a plurality of recesses in at least the forefoot portion and the midfoot portion;

each of the recesses extends toward the second side without extending to the second surface;

each of the recesses is configured so that a thickness of the midsole between the second side and a deepest extent of each of the recesses is substantially uniform in dimension, the midsole is a unitary foam material that has a first density in a first portion along the first surface and the second surface, and a second density in a second portion inward of the first portion; and the second density is less than the first density.

2. The sole structure of claim 1, wherein:

the recesses include a first set of recesses in one of the forefoot portion and the midfoot portion and a second set of recesses in another one of the forefoot portion and the midfoot portion;

wherein the recesses of the first set of recesses are spaced from one another to establish a first minimum wall thickness between adjacent ones of the recesses of the first set of recesses;

wherein the recesses of the second set of recesses are spaced from one another to establish a second minimum wall thickness between adjacent ones of the recesses of the second set of recesses; and wherein the second minimum wall thickness is different than the first minimum wall thickness.

3. The sole structure of claim 2, wherein at least some of the recesses of the first set of recesses have different depths than one another.

4. The sole structure of claim 3, wherein at least some of the recesses of the second set of recesses have different depths than one another.

5. The sole structure of claim 2, wherein the first set of recesses is in the forefoot portion; wherein the second set of recesses is in the midfoot portion;

and wherein the first minimum wall thickness is greater than the second minimum wall thickness.

6. The sole structure of claim 2, wherein each of the recesses has a polygonal shape.

7. The sole structure of claim 1, wherein the recesses are spaced from one another in correspondence with pressure zones of a foot pressure map so that adjacent recesses of a first set of recesses in a relatively high pressure region of the foot pressure map are further from one another than adjacent recesses of a second set of recesses in a relatively low pressure region of the foot pressure map; and wherein the foot pressure map is a mapping of pressures applied to a test midsole during wear testing.

8. The sole structure of claim 7, wherein at least some of the recesses in the relatively low pressure region have a larger effective diameter than at least some of the recesses in the relatively high pressure region.

9. The sole structure of claim 1, wherein the midsole has a first weight; wherein the first weight is less than the second density multiplied by a sum of a volume of the midsole and a volume of the recesses.

10. A sole structure for an article of footwear comprising:

a unitary, one-piece foam midsole that has an outer surface with a first side and a second side opposite from the first side; wherein the midsole has a heel portion, a midfoot portion, and a forefoot portion, the forefoot portion extending from a foremost extent of the midsole to the midfoot portion; wherein:

the first side has a plurality of recesses extending toward the second side without extending to the outer surface at the second side;

the recesses are spaced from one another in correspondence with pressure zones of a foot pressure map so that a first set of recesses are in a relatively high pressure region of the foot pressure map and a second set of recesses are in a relatively low pressure region of the foot pressure map and are closer to one another than the first set of recesses;

the foot pressure map is a mapping of pressures applied to a test midsole during wear testing;

the foam has a first density at the outer surface and a second density in a remainder of the midsole; wherein the first density is greater than the second density; and the recesses are configured with varying depths so that a thickness of the midsole between the second side and a deepest extent of each of the recesses is substantially unvarying throughout the forefoot region and the midfoot region.

11. The sole structure of claim 10, wherein the recesses of the first set of recesses are spaced from one another to establish a first minimum wall thickness between adjacent ones of the recesses of the first set of recesses;

wherein the recesses of the second set of recesses are spaced from one another to establish a second minimum wall thickness between adjacent ones of the recesses of the second set of recesses; and wherein the second minimum wall thickness is different than the first minimum wall thickness.

12. The sole structure of claim 10, wherein at least some of the recesses in the relatively low pressure region have a larger effective diameter than at least some of the recesses in the relatively high pressure region.

13. The sole structure of claim 10, wherein each of the recesses has a hexagonal shape.

14. The sole structure of claim 1, wherein a distance from the first side to the second side varies in the forefoot region and the midfoot region in accordance with a variance in depth of the recesses.

15. The sole structure of claim 10, wherein a distance from the first side to the second side varies in the forefoot region and the midfoot region in accordance with the varying depths of the recesses.

16. The sole structure of claim 1, wherein the first surface is an outer surface of the midsole that extends within and defines each of the recesses.

17. The sole structure of claim 16, wherein the outer surface is a skin integral with the second portion.

18. The sole structure of claim 10, wherein the outer surface extends within and defines each of the recesses.

19. The sole structure of claim 18, wherein the outer surface is a skin integral with the remainder.

* * * * *